United States Patent [19]

Kuhn et al.

[11] Patent Number: 4,627,584

[45] Date of Patent: Dec. 9, 1986

[54] METHOD AND APPARATUS FOR FEEDING A PLASTIC RIBBON

[75] Inventors: Philip A. Kuhn, Canandaigua; Paul V. Osborn, Webster, both of N.Y.

[73] Assignee: Mobil Oil Corporation, New York, N.Y.

[21] Appl. No.: 842,071

[22] Filed: Mar. 18, 1986

Related U.S. Application Data

[63] Continuation of Ser. No. 652,253, Sep. 20, 1984, abandoned.

[51] Int. Cl.[4] ..... B65H 16/00; B65H 27/00; B65H 23/04

[52] U.S. Cl. ..... 242/54 R; 226/190; 226/196; 242/76; 242/DIG. 2

[58] Field of Search ..... 226/76, 189, 190, 196, 226/197, 183, 187; 242/DIG. 2, 55, 67.3 R, 76, 54 R

[56] References Cited

U.S. PATENT DOCUMENTS

| | | | |
|---|---|---|---|
| 2,644,384 | 7/1953 | Forgett | 226/190 X |
| 3,145,947 | 8/1964 | Stanley | 226/189 X |
| 3,360,173 | 12/1967 | Miller . | |
| 3,393,849 | 7/1968 | Hass . | |
| 3,991,956 | 11/1976 | Machida . | |
| 4,084,683 | 4/1978 | Moss . | |
| 4,114,751 | 9/1978 | Nordin . | |
| 4,335,857 | 6/1982 | Pfost et al. | 226/190 X |
| 4,343,422 | 8/1982 | Dabringhaus et al. . | |
| 4,385,716 | 5/1983 | De Roeck et al. . | |

FOREIGN PATENT DOCUMENTS

| | | | |
|---|---|---|---|
| 503396 | 6/1954 | Canada | 226/196 |
| 695040 | 9/1965 | Italy | 226/189 |
| 101542 | 8/1980 | Japan | 226/190 |

OTHER PUBLICATIONS

Ingham, Traverse-Wound Spools for Component Taping Machine, Western Electric Tech. Digest, No. 27, 7/1972.

*Primary Examiner*—Stanley N. Gilreath
*Assistant Examiner*—Lynn M. Sohacki
*Attorney, Agent, or Firm*—Alexander J. McKillop; Michael G. Gilman; Charles J. Speciale

[57] ABSTRACT

A method of and apparatus for feeding a continuous thin film plastic tape or like, pliable, foldable strip in an oscillatory fashion, which may be random, from a feed surface having a width many times greater than the width of said tape to a receiving surface having a width at least as great as a tape width and many times narrower than the width of the feed surface by spacing and positioning the feed and receiving surfaces with respect to one another to limit the maximum angle between a transverse plane bisecting the receiving surface and extending towards the approaching tape and the centerline of the tape. The maximum value of this angle, in degrees, is about 6.5 times the inverse of the tape width expressed in inches. The invention is illustrated with an apparatus which converts the oscillatory motion of a tape fed from a roll many times wider than the tape over an equally large roller surface to a pulley only slightly wider than the tape and many times smaller than the roller surface.

33 Claims, 6 Drawing Figures

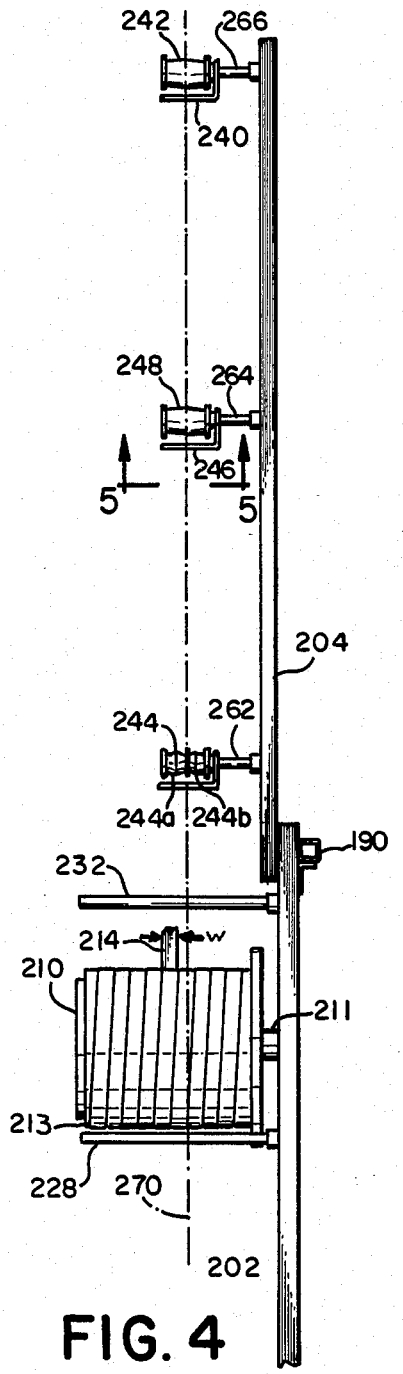
FIG. 4
FIG. 5
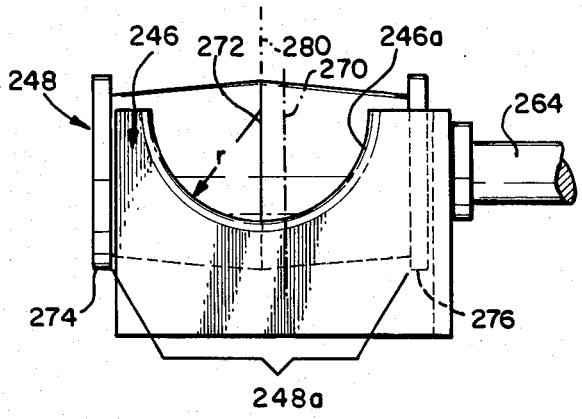
FIG. 6
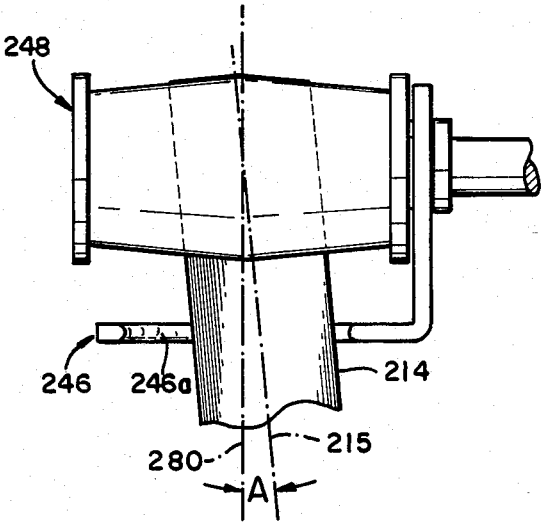

METHOD AND APPARATUS FOR FEEDING A PLASTIC RIBBON

This is a continuation of copending application Ser. No. 652,253, filed on Sept. 20, 1984 now abandoned.

FIELD OF THE INVENTION

The invention relates to a method and apparatus for feeding an extremely pliable, flexible plastic ribbon or tape from any portion of an enlarged feed surface many times wider than the tape to a receiving surface wider than the tape, but many times smaller than the feed surface without the tape folding upon itself.

BACKGROUND OF THE INVENTION

It is sometimes necessary or desirable to feed a thin plastic ribbon or tape from a spool or other feed surface many times wider than the tape width to a pulley or other smaller tape turning surface. A problem sometimes encountered is that the tape, which does not have significant rigidity, will bend or fold on itself between the feeding device and turning device and be fed from the turning device in a doubled or reversed condition.

SUMMARY OF THE INVENTION

It is an object of the invention to provide a novel method and apparatus for feeding an extremely pliable thermoplastic tape or other extremely bendable and foldable continuous tape between two spaced-apart surfaces so as to prevent the tape from folding upon itself.

It is yet another object of the invention to provide a novel method and apparatus for feeding a thermoplastic tape from anywhere on a feed surface many times wider than the width of the tape to a receiving surface many times smaller than the width of the feed surface without folding of the tape on itself.

It is yet another object of the invention to provide a method and apparatus for feeding a pair of extremely pliable thermoplastic tapes from a pair of separate spools many times wider than the width of either in a parallel, side by side orientation.

It is yet another object of the invention to provide a method and apparatus for converting side to side oscillating movement of a tape as it is longitudinally fed over a surface many times wider than the width of the tape to an essentially non-oscillating longitudinal movement.

According to the invention, a thermoplastic film tape or other extremely pliable, bendable and foldable tape having a width many times greater than its thickness can be fed from any position on a feed surface such as a spool or roller having a width many times greater than the tape width to a tape receiving surface, such as the surface of a tape guide as a pulley or other turning element, having a width at least as great as the width of said tape but many times narrower than the width of said feed surface, by spacing the tape turning surface sufficiently far from the feed surface such that the maximum angle of the approaching tape is kept about or below a critical maximum angle. The critical angle is measured between the centerline of the tape transverse to its width and a central transverse plane of the receiving surface. Preferably, the central transverse plane of the receiving surface is coincident with or only displaced slightly from a central transverse plane of the feed surface. For a one inch wide polyethylene film tape, the critical maximum angle has been found to be about 6.5°. It is believed that a reasonable approximation of the critical maximum angle A for tapes of other widths, particularly widths greater than one inch, is given by the relationship, $A=6.5°/w$, where "w" is the width of the tape expressed in inches.

According to another aspect of the invention, a tape guide surface is positioned between the feed and turning surfaces adjoining the turning surface to increase the angle of wrap of the tape about the turning surface. The tape guide surface is substantially symmetric about the central transverse plane of the turning surface and the angle between the tape centerline and said plane is measured with respect to the tape approaching the guide surface.

According to yet another important aspect of the invention, the turning surface is preferably provided by a crown pulley.

According to yet another important aspect of the invention, the guide surface is preferably semi-cylindrically concave and complementary with the convex turning surface provided by the crown pulley.

The aforesaid objects and advantages and other objects and advantages are provided by the invention, a detailed description of which follows.

BRIEF DESCRIPTION OF THE DRAWINGS

FIG. 4 is an orthogonal side view of the apparatus of FIG. 3;

FIG. 5 is a side view of a guide and pulley assembly of the device of FIGS. 3 and 4 along lines 5—5 of FIG. 4; and FIG. 6 is an orthogonal side view of the assembly of FIG. 5 showing the angle A between the approaching tape and the central transverse plane of the guide and roller.

DETAILED DESCRIPTION OF THE INVENTION

Figure 1:
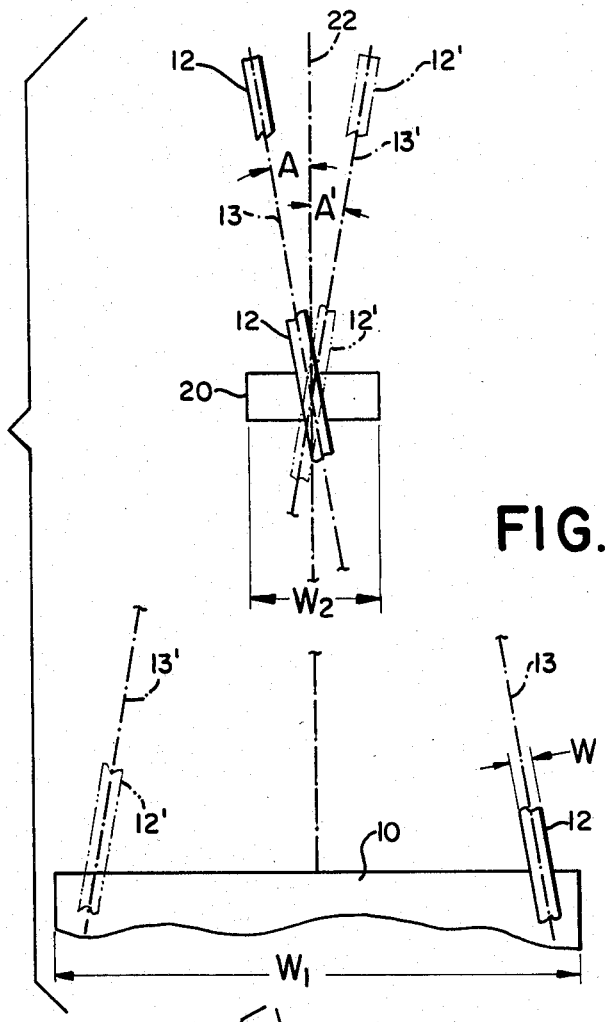
FIG. 1 depicts diagrammatically the relationship between a tape feed surface and a symmetric tape receiving surface according to the invention.

In FIG. 1, feed surface 10, having a width $W_1$, feeds a continuous, extremely pliable, bendable and foldable tape 12 such as a thermoplastic film tape, from any point along the width $W_1$ of the feed surface 10 directly to a tape receiving surface 20 spaced from the feed surface 10. The tape 12 has a width w many, many times greater than its thickness. The width $W_1$ of the feed surface 10 is many times greater than the width w of the tape 12. The width $W_2$ of the tape receiving surface 20 is at least as great as the width w of the tape 12 but many times less than the width $W_1$ of the tape feed surface. The widths of the feed and receiving surfaces are measured substantially parallel to the width of the tape crossing the surface. The tape turning surface 20 has a central transverse plane 22 extending in and out of the figure, directed generally towards the feed surface. This plane 22 at least substantially bisects the tape receiving surface V contacted by the tape when fed from either extreme side of the feed surface or any position therebetween. In the depicted embodiment, plane 22 is also a plane of symmetry of both the surface 20 and the tape feed surface 10, but this is not a requirement. The tape 12 has a centerline 13 transverse to its width. This centerline is indicated for a tape being fed from the extreme right side of the feed surface 10. The centerline 13 of the same tape fed from that position is also indicated (in an exaggerated orientation for clarity) as it crosses the turning surface 20. According to the invention, the maximum angle of approach A between the centerline 13 of the tape 12 and the central plane 22 of the surface 20 must be at or below a critical angle to prevent the tape 13 from folding upon itself when passing over the turning surface 20. The same is true for the angle A' between the centerline 13' of a tape 12' fed from the extreme left portion of the feed surface 10 as it crosses the receiving surface 20. This maximum angle of approach can be controlled by centering the turning surface 20 with respect to the feed surface 10 and by spacing the turning surface 20 sufficiently far from the feed surface 10. For a one inch wide polyethylene tape, the maximum angle has been found to be about 6.5°. It is believed that the maximum angle "A" is related to tape width "w" in inches by the relationship $A=6.5/w$, particularly for tapes greater than one inch in width.

Figure 2:
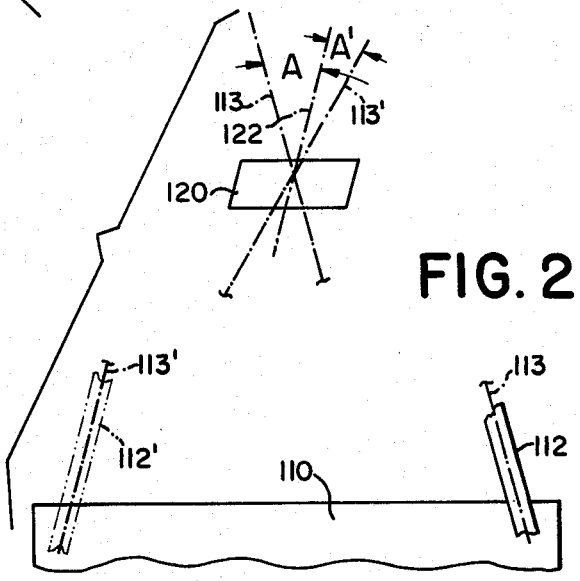
FIG. 2 depicts diagrammatically the relationship between a tape feed surface and a non-symmetric tape receiving surface.

FIG. 2 depicts the angles A and A' with respect to a centerline 122 bisecting the width of a non-symmetric receiving surface 120 and centerlines 113 and 113' of tapes 112 and 112', respectively, fed from the outer edges of a surface 110.

Figure 3:
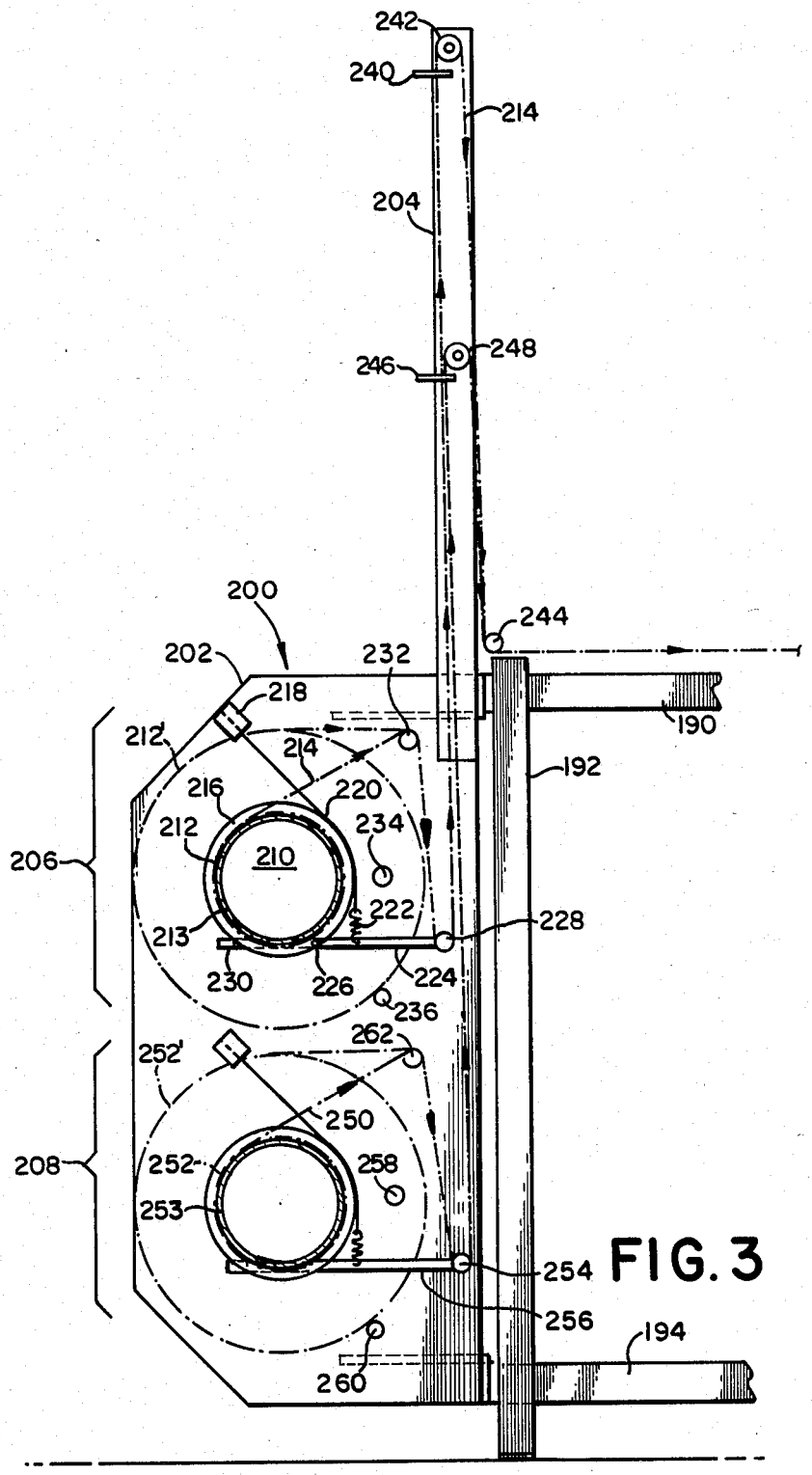
FIG. 3 depicts a side view of an apparatus according to the subject invention for feeding a pair of plastic film tapes from parallel mounted spools in a side by side fashion.

FIG. 3 depicts a twin tape feed apparatus incorporating the subject invention to convert oscillating motion in and out of the plane of the figure of each of a pair of tapes as they are fed from a pair of spools many times wider than the width of the tapes to an essentially non-oscillatory motion over pulleys receiving the tapes. The apparatus 200 includes a plate 202 and mast assembly 204 affixed thereto by suitable fasteners such as nuts and bolts, screws, etc. (not depicted). The plate 202 supports the mast assembly 204 in an upright position and is, in turn, supported itself on stationary frame members 190 and 194, extending behind the plate 202 in FIG. 3. The plate 202 mounts two substantially identical hub assemblies 206 and 208. The upper assembly 206 includes a rotatable, cylindrical hub 210, mounting a cylindrical spool 213 wound with a thin, thermoplastic tape 214. The minimum and maximum dimensions of the wound tape are indicated by broken lines 212, and 212', respectively. A flange 216 affixed to the hub 210 near its base acts as a stop when mounting the spool 212. A leather strap 220 extending from a pylon 218 fixed to the plate 202 contacts a portion of the circumferential outer surface of the flange 216 and acts as a drag brake. The other end of the strap 220 is fixed by means of a spring 222 to a dancer arm 224 mounted between the plate 202 and flange 216 at a pivot point 226 for rotation. A roller 228 is provided at one end of the arm 224 and a moveable counterweight 230 is provided at its opposing end and is adjustable to control tension on the strap. The tape 214 is fed from the spool 213 about a roller 232, fixedly mounted to the plate 202, about the roller 228 on the dancer arm 224 and up the mast 204 over a tape guide surface 240, mounted proximal to and upstream from a crown pulley 242, itself mounted to the mast. The tape is reversed over the crown pulley 242 and fed down the mast 204 to one of two pulley surfaces of a double crown pulley 244. Lastly, stops 234 and 236 are provided to delimit the arc of the arm 224. The lower assembly 208 has the same components and operates in the same manner as the upper assembly 206. A thermoplastic tape 250 is fed from a spool 253 of the lower assembly and passes over a roller 252 fixedly mounted to the plate 202 around a roller 254 of the lower assembly dancer arm 256 and up the height of the plate 202 and mast 204 to a lower tape guide 246 and adjoining single crown pulley 248. The tape 250 passes from the pulley 248 to the remaining pulley surface of the double crown pulley 244 and is fed from that pulley in a parallel and side by side relationship with the tape 214 (i.e., in a horizontal plane perpendicular to the plane of FIG. 3). The lower assembly 208 is also provided with dancer arm stops 258 and 260, positioned comparably to stops 234 and 236 of the upper assembly 206. The vertical spacing between the lower guide and pulley 246–248 and upper guide and pulley 240–242, as viewed in FIG. 3, is the same as the spacing of the comparable elements of the hub assembly 208 and 206 from one another. The pivot points of the two dancer arms 224 and 256 are shifted laterally from one another as are the guide and roller pairs 240–242 and 246 and 248 to eliminate tape interference.

As can be seen from FIG. 4, an orthogonal side view of the apparatus 200 of FIG. 3, the width of the hub 210, spool 213, fixed roller 232 and dancer roller 228 are many, many times greater than the indicated width w of the tape 214. The hub 210 is supported by means of bearings (not depicted) on a shaft 211 fixed to the plate 202. Broken line 270 is a plane in and out of the plane of the figure that approximately bisects the spool 212 and the rollers 228 and 232. The double crown roller 244 is supported by means of a shaft 262 fixedly mounted to the mast 204 so as to also be bisected by the line 270 so that the individual crown roller surfaces **244*a* and 244*b* lie above and below the plane 270, respectively. The lower single crown pulley 248 and its associated tape guide 246 are supported slightly to the left of the center plane 270 by shaft 264 fixedly mounted to the mast 204, while upper single crown pulley 242 and its associated tape guide 240 are supported slightly to the right of the center plane 270 by shaft 266, also fixedly mounted to the mast 204**, also to prevent tape interference.

The lower tape guide-pulley pair 246–248 is depicted in greater detail in FIG. 5. The upper pair 240–242 is substantially identical. The tape guide 246 is fixedly mounted to the shaft 264 upstream from the crown pulley 248. The guide 246 has a cylindrically concave guide surface **246*a* with a radius of curvature r. The pulley 248 has a pulley surface 248*a* with a central circumferential crown 272. Flanges 274 and 276 delimit the pulley surface 248*a*. The crown 272 lies in a plane of symmetry 280 of both the guide surface 246*a* and roller surface 248*a*. Looking at the guide 246 and pulley 248 in FIG. 3, the plane of symmetry 280 is offset slightly to the left of the plane formed by the centerline 270. The tape contacting surface of guide 240 and roller surface of roller 242 similarly have a common plane of symmetry which is symmetrically offset slightly to the right of the plane 270 in FIG. 4. The guide 246 and roller 248 are positioned sufficiently distant from the dancer roller 228 so that the maximum angle of attack A of the centerline of the tape 214 approaching the guide surface 246 from the roller 228 is less than about 6.5°. The guide 246 increases the angle of wrap of the tape around the crown roller 248. The concavity of the guide 248 cooperates with the convexity of the crown roller surface 246*a*** to assist in centering the tape on that surface. The semi-cylindrical guide surface has been found to provide better performance than other types of concave surfaces, such as a V-notched surface. The use of a crown roller is a well known method of centering a tape which may move or may tend to move axially with respect to the pulley.

The relationship of this angle A to the tape and plane of symmetry is depicted in FIG. 6, another orthogonal side view of the roller and guide of FIG. 5. The maximum angle A between the plane of symmetry 280 and the centerline 215 of the tape 214 being fed from the roller 228 must be about 6.5° or less to prevent the tape from folding lengthwise upon itself upon contacting the guide or in passing from the guide to the pulley 248. FIG. 6 depicts the tape 214 in the position it would take if fed from the extreme right end of roller 228 as viewed in FIG. 3. Since the feed surface of the roller 228 is at least substantially symmetric with respect to the centerline 270 and the plane of symmetry 280 of the guide 246 and roller 248 is offset to the left of that line (as viewed in FIG. 3), this represents, at the point of closest approach of the roller 228 to the guide 246, the maximum angle A between the centerline 215 and plane of symmetry 280. According to the invention the guide 246 is positioned sufficiently far from the point of closest approach to the roller 228 so that this angle A is about 6.5° or less.

By means of example, an apparatus similar to that depicted in FIGS. 3–6 has been built and successfully operated feeding a polyethylene ribbon approximately 1 inch in width from a spool 212, approximately 12 inches in axial length over rollers 232 and 228, also about 12 inches in axial length to a guide 246 having a semicircular surface 248 with a ¾ inch central radius and accompanying crown pulley with a pulley surface approximately 2 inches wide and a 5° crown angle. The effective width of the feed surface (dancer roller 228) is 11 inches measured from centerline of the tapes at the extreme side edges of the roller. The spacing between the guide and the dancer roller at point of closest approach is in excess of 48 inches providing a maximum angle A of about 6.5° [i.e., tan. 5.5/48].

Although the invention has been described using a crown pulley surface, it is envisioned that other types of turning surfaces such as a roller or radius turning edge might be used with the invention, particularly if the tape used were narrower and/or the angle of attack is held below the suggested critical angle for the tape width employed. Similarly, other types of guide surfaces, such as a semi-elliptical surface or a V-notched type surface might also be employed with similar reduction in tape width or angle of attack or both. Moreover, while the invention has been described for use with a feed surface such as a roller or spool having a substantially straight tangential surface from which the tape is fed, it is envisioned the invention might be used with feed surfaces having curvilinear forward feeding edges. Similarly, although the invention has been described with respect to tape receiving surfaces (guide and/or pulley) which are symmetric to a central plane through the tape contacting surface, it is envisioned the invention can similarly be favorably employed with tape receiving surfaces which are not symmetric with respect to their central plane.

While several embodiments have been described and modifications thereto suggested, other embodiments and modifications will occur to one skilled in the art. Therefore, the invention is not limited to the described embodiments, but is set forth in the accompanying claims.

I claim:

1. An apparatus for feeding a continuous, plastic film tape having a width many times greater than its thickness comprising:

a tape feed surface over which said ribbon is fed, having a predetermined width many times greater than said tape width;

a tape turning surface spaced from the tape feed surface for redirecting said tape and having a curvilinear width not less than said tape width and at least several times narrower than said feed surface width; and a tape guide positioned adjoining the tape turning surface between that surface and the feed surface for increasing the wrap of the tape over said turning surface and having a curvilinear guide surface across which the tape is fed and a fixed transverse plane at least substantially bisecting the width of said guide surface and extending towards the approaching tape and said tape feed surface, the position of the tape feed surface being fixedly secured against transverse movement in a direction normal to said fixed transverse plane, the tape guide being spaced sufficiently far from the feed surface and oriented with respect to the feed surface such that the maximum angle in degrees formed between the tape fed from any position on the feed surface and said transverse plane is no greater than 6.5 times the inverse of said tape width expressed in inches.

2. The apparatus of claim 1 wherein said tape guide surface and turning surface are positioned above said feed surface and said tape is fed essentially vertically from said feed surface to the guide surface.

3. The apparatus of claim 1 wherein said guide surface is substantially concave.

4. The apparatus of claim 3 wherein said turning surface is a crown surface of a crown pulley.

5. The apparatus of claim 4 wherein said guide surface is substantially semi-cylindrical.

6. The apparatus of claim 1 wherein said turning surface is a crown surface of a crown pulley.

7. The apparatus of claim 6 wherein said crown pulley is symmetric with respect to said transverse plane.

8. The apparatus of claim 7 wherein said feed surface is also at least substantially symmetric with respect to said transverse plane.

9. The apparatus of claim 8 wherein said guide surface is concave.

10. The apparatus of claim 9 wherein the guide surface is substantially semi-cylindrical.

11. The apparatus of claim 10 wherein the guide and pulley are positioned above the feed surface and the tape is fed substantially vertically from the feed surface to the guide.

12. The apparatus of claim 10 wherein the tape is about one inch or more in width.

13. The apparatus of claim 5 wherein the tape is about one inch or more in width.

14. The apparatus of claim 1 wherein the tape is about one inch or more in width.

15. An apparatus for feeding a continuous, plastic film tape having a width many times greater than its thickness comprising:

a feed surface having a width over which said tape is fed many times greater than said tape width;

a pulley spaced from the feed surface having a crown turning surface with a circumferential crown line defining a fixed plane through the pulley, the turning surface being at least as wide as said tape and many times smaller than said feed surface;

a guide surface adjoining said crown pulley for receiving said tape directly from said feed surface and increasing the wrap of said tape about said pulley; and said feed surface being fixedly secured against transverse movement in a direction normal to said plane and the pulley and guide surface being positioned with respect to one another and to the feed surface such that the angle in degrees between the tape approaching the guide and said plane through the pulley from any location on said feed surface is no greater than about 6.5 times the inverse of said tape width expressed in inches.

16. The apparatus of claim 15 wherein the guide surface is concave.

17. The apparatus of claim 16 wherein the guide surface is semi-cylindrical.

18. The apparatus of claim 15 wherein the guide surface is symmetric with respect to said plane.

19. The apparatus of claim 18 wherein the guide surface is concave.

20. The apparatus of claim 19 wherein the guide surface is semi-cylindrical.

21. The apparatus of claim 20 wherein the guide surface and pulley are positioned above the feed surface and the tape is fed substantially vertically from the feed surface to the guide.

22. The apparatus of claim 21 wherein the tape has a width of about one inch or more.

23. The apparatus of claim 17 wherein the tape has a width of about one inch or more.

24. The apparatus of claim 15 wherein the tape has a width of about one inch or more.

25. A plastic film tape feed apparatus comprising:

a spool having a multiplicity of wraps of a plastic film tape around a spool surface having an axial length many times greater than the width of said tape;

a cylindrical turning surface proximal to the spool having an axial length approximately equal to the axial length of the wrapped surface of the spool;

a pulley spaced from said turning surface for redirecting the direction of the tape fed from the turning surface;

a concave tape guide surface adjoining the pulley, receiving said tape directly from said turning surface, increasing the wrap of said tape about said pulley and having a width transverse to the fed tape greater than said tape width and several times smaller than said axial length of the turning surface and further having a fixed central plane of symmetry extending in a direction generally transverse to a central axis of said cylindrical turning surface;

said cylindrical turning surface being fixedly secured against transverse movement in a direction normal to said central plane of symmetry; and the tape guide surface being positioned sufficiently far from the cylindrical surface such that the maximum angle in degrees between a tape fed from any point on said turning surface and said plane of symmetry is no greater than about 6.5 times the inverse of the width of said tape expressed in inches.

26. The apparatus of claim 25 wherein said pulley is crowned and shares a common plane of symmetry with the tape guide surface.

27. The apparatus of claim 26 wherein said tape guide surface is semi-cylindrical.

28. A method of advancing a continuous, plastic film tape having a width many times greater than its thickness, comprising the steps of:

passing the tape over a first surface having a width contacted by the fed tape several times greater than the width of said tape;

receiving the tape fed from the first surface over a second surface having a width contacted by the fed tape at least as great as the width of said tape and many times narrower than said width of said first surface; and positioning the first and second surfaces relative to one another such that the maximum angle formed between the centerline of the tape fed from anywhere across the width of said first surface to said second surface and a fixed transverse plane bisecting the width of the second surface portion contacted by the tape is sufficiently small to prevent the tape from folding upon itself while passing over the second surface when the first surface is fixedly secured against transverse movement in a direction normal to said transverse plane.

29. The method of claim 28 wherein said step of positioning further comprises:

limiting said maximum angle to a value in degrees of about 6.5 times the inverse of the tape width expressed in inches.

30. A method of advancing a continuous, plastic film tape or a like pliable, foldable strip having a width many times greater than its thickness comprising the steps of:

providing feed means having a feed surface across which said tape is fed in an oscillatory fashion and a feed surface width many times greater than said width of the tape;

providing receiving means having a receiving surface for receiving the tape directly from the feed means, the receiving surface having a width over which said tape is received at least as great as said tape width and many times narrower than said feed means surface width; and holding the feed means surface and receiving means surface fixedly secured against transverse movement in a direction normal to a fixed central transverse plane at least substantially bisecting the receiving means surface and extending towards the feed means surface and tape approaching the receiving means surface while positioning said feed means surface and receiving means surface with respect to one another such that the maximum value, in degrees, of an angle formed by an intersection of said central transverse plane and a longitudinal, centerline of the tape as the tape approaches said receiving means surface from any position along the width of said feed means surface, is no greater than about 6.5 times the inverse of the surface width of said tape expressed in inches.

31. The method of claim 30 wherein said tape is fed in a random, oscillatory fashion across said width of said feed means surface.

32. An apparatus for advancing a continuous, plastic film tape or like pliable, foldable strip having a width many times greater than its thickness comprising:

feed means for feeding said tape from a feed means surface in an oscillatory fashion over a width of the feed means surface many times greater than said width of the tape;

receiving means for receiving the tape directly from said feed means on a receiving means surface having a width at least as great as said tape width and many times narrower than said feed means surface width; and said feed means surface and receiving means surface being positioned with respect to one another such that the maximum value, in degrees, of an angle formed by an intersection of a fixed central transverse plane at least substantially bisecting the receiving means surface and extending towards the feed means surface and the tape approaching the receiving means and a longitudinal centerline of the tape as the tape approaches said receiving means surface from any position along the width of said feed means surface, is no greater than about 6.5 times the inverse of the width of said tape expressed in inches while the feed means surface and receiving means surface are held fixedly secured against transverse movement in a direction normal to said central transverse plane.

33. The apparatus of claim 32 wherein said feed means feeds said tape in a random oscillatory fashion across said width of the feed means surface.

* * * * *